US006155414A

United States Patent [19]

Vaessen

[11] Patent Number: 6,155,414

[45] **Date of Patent: *Dec. 5, 2000**

[54] BLISTER PACK

[75] Inventor: Leonardus H. F. Vaessen, Son en Breugel, Netherlands

[73] Assignee: U.S. Philips Corporation, New York, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 09/115,784

[22] Filed: Jul. 14, 1998

[30] Foreign Application Priority Data

Jul. 15, 1997 [EP] European Pat. Off. ..... 97202188

[51] Int. Cl.[7] ..... B65D 75/58

[52] U.S. Cl. ..... 206/232; 206/469

[58] Field of Search ..... 206/232, 460, 206/461–471, 472

[56] References Cited

U.S. PATENT DOCUMENTS

| | | | |
|---|---|---|---|
| 3,278,015 | 10/1966 | Bernstein | 206/461 |
| 4,752,003 | 6/1988 | Miller et al. | 206/232 |
| 4,803,048 | 2/1989 | Nason | 206/469 |
| 4,840,275 | 6/1989 | Faiola et al. | 206/462 |
| 5,377,836 | 1/1995 | Eisenbraun | 206/461 |

FOREIGN PATENT DOCUMENTS 2545342 11/1984 France .

*Primary Examiner*—Jim Foster
*Attorney, Agent, or Firm*—Ernestine C. Bartlett

[57] ABSTRACT

The invention discloses a blister package which includes a transparent box with an open side which is attached at a flange at its open side to a front page of a booklet. The booklet is kept closed by a removable connection strip and can be opened or examined, only, then when the package is opened. The package can be hung at a slot present in a bridging strip which is connected with a back strip, the front page, a back page and the connection strip. The front of the package may be covered with a cover page having an opening through which the box protrudes and remains visible.

8 Claims, 3 Drawing Sheets

BLISTER PACK

BACKGROUND OF THE INVENTION

Description

The invention relates to a blister pack comprising:

a booklet with a front cover, a back cover, a spine by means of which the front cover and the back cover are interconnected, and a leafing side opposite the spine where the booklet can be opened;

a box comprising a base with a circumferential raised wall with a flange connected thereto, and opposite the base an open side, which open side is at least substantially closed off by the front cover, while the flange is adhered to the booklet.

Such a blister pack is known from U.S. Pat. No. 4,752,003. In the known pack, the booklet and the box are adhered to one another by means of their flange and front cover. A product may be placed in the closed space created thereby. After opening, it is impossible to return the pack to its original state. The booklet is not closed and can be freely inspected by customers beforehand.

It is a disadvantage of this pack that there is a real risk of considerable damage to the booklet when the box and the booklet are separated. A second disadvantage is that the booklet may readily become damaged and polluted because it is not closed.

It is noted that a blister pack comprising a combination of a closed box and a booklet which lie in one another's extended directions is known from FR-A-2 545 342. The booklet is adhered to an edge of the box at the leafing side. The booklet and the box can be separated from one another along a perforation provided at the leafing side. A tag is present at the booklet with a Euroslot therein through which, for example, a pin may be passed so as to suspend the pack. A disadvantage of this pack is that it occupies an additional space owing to the placement of the booklet in relation to the box. A second disadvantage is that the booklet is immediately recognizable as such and as it were invites customers to inspect it without authorization and accordingly separate it from the box.

Another blister pack is known from U.S. Pat. No. 5,377,836. This pack comprises a doubled-up cardboard display card which forms a back cover and a front cover on which a box is adhered. The doubled-up display card has a tendency to open itself owing to the resilient action of the cardboard. A tag is fastened to the box at the opening side, which tag grips around the front cover and the back cover, so that the doubled-up display part is kept closed.

It is a disadvantage of this pack that the information on the display card may be lost owing to damage during opening. A second disadvantage is that the back cover may have creases after repeated opening of the doubled-up display card, so that it is no longer retained behind the tag, and the pack remains open spontaneously.

SUMMARY OF THE INVENTION

It is an object of the invention to provide a blister pack of the kind described in the opening paragraph which is sturdy and compact and whose booklet can be opened or examined only after the pack has been opened.

According to the invention, this object is achieved in a blister pack wherein the spine comprises a spine strip which lies in the extended direction of the front cover along the spine when the booklet is closed, the front cover and the back cover are furthermore interconnected by means of a connection strip situated at the leafing side, and the flange is adhered to the connection strip and to the spine strip.

The booklet may be protected against unauthorized opening, for example, when the front cover and the back cover are interconnected at the leafing side. A good closure of the booklet is obtained by means of a connection strip which connects the front cover over its entire length to the back cover at the leafing side. The material is locally solidified and reinforced in that the front cover and the back cover, and possibly the sheets present between them, are glued to the connection strip, so that the closure of the booklet is further improved. Gluing together of the front cover, the back cover, and any interposed sheets also in the spine strip solidifies and reinforces the material here as well, further improving the adhesion of all pages. The combination of the box and the booklet, and the assembled form thereof, results in a compact blister pack which has the advantage that both the booklet and the box are securely closed.

When the blister pack is opened, the connection strip can be removed, for example with a pair of scissors. In a preferred embodiment, the connection strip is connected to the front cover and the back cover along a perforation line. After the booklet and the box have been separated, opening of the booklet is facilitated in that the connection strip can be torn off along the perforation line provided.

A preferred embodiment of a blister pack is one in which a bridging strip provided with an opening is present, which bridging strip lies in the extended direction of the front cover and is connected to the spine strip, the front cover, the back cover, and the connection strip. The opening may have the shape, for example, of a Euroslot. An effective use of the shelf space and an orderly product presentation are rendered possible in that the pack is suspended from, for example, a hook which projects through the opening provided in the bridging strip. The booklet will also be better protected against unauthorized inspection at the same time.

In an embodiment comprising a cover sheet, there is an opening in said cover sheet through which the box remains largely visible, but where at least the portions of the flange connected to the spine strip and the connection strip are covered. The blister pack is better protected against unauthorized opening thereby. It is furthermore possible, for example, for perforations and an additional recess to be provided, which facilitate the removal of the cover sheet, if so desired. This cover sheet provides an additional advantage when, for example, a generally used thermal process step is carried out by means of which the box is adhered to the booklet. The glue flows out when heated to a comparatively high temperature, solidifies again after cooling-down, and then ensures the adhesion between the box and the booklet. The box material must be protected from the heater element, for example by the material of the booklet, so as to prevent an inadvertent adhesion to the heater element or melting of the box material. It is easier for the heat to be supplied through the single layer of the cover sheet than through the multiple layers of the booklet. As a result, the required quantity of energy is comparatively small and the process can proceed comparatively quickly.

In another embodiment, the surface layers of the spine strip facing towards the box and the front cover are separated by a groove. The risk of an inadvertent simultaneous removal of a finish which forms part of the surface layer of the front cover during the removal of the box is reduced thereby. The risk that information is lost and that the booklet is damaged is also reduced thereby.

In general, any combinations as desired may be made of the various embodiments. It is also possible to choose the materials for the packaging, inks, and adhesive agents such that the recycling possibilities thereof are taken into account, so that an environmentally friendly product is obtained. The booklet may be made, for example, from graphical paper and cardboard types, for example duplex cardboard with a typical weight of, for example, 0.2 kg/m$^2$. The box may be made, for example, from a thermoplastic material, for example transparent polyethylene with a typical weight of, for example, 0.3 kg/m$^2$. The resulting pack is suitable, for example, for packing batteries.

BRIEF DESCRIPTION OF THE DRAWINGS

Embodiments of the blister pack according to the invention and a folded-out blank are shown in the drawings, in which.

DESCRIPTION OF THE PREFERRED EMBODIMENTS

Figure 1:
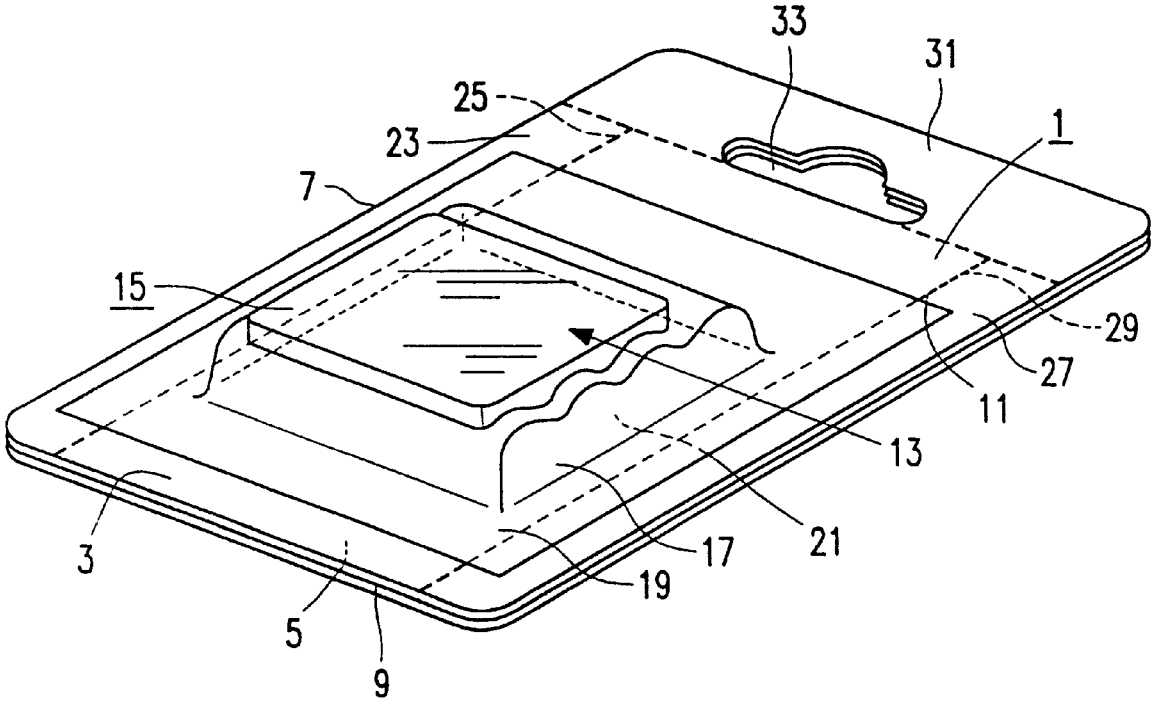
FIG. 1 shows the blister pack in perspective view.

The blister pack of FIG. 1 comprises a booklet 1 with a front cover 3, a back cover 5, and a spine 7 by means of which the front cover 3 and the back cover 5 and a number of interposed pages 9 are connected to one another. Opposite the spine 7 there is a leafing side 11 where the booklet 1 can be opened. The pack further comprises a box 13, comprising a base 15 with a circumferential upright wall 17 with a flange 19 connected thereto. Opposite the base 15, there is an open side 21 which is closed off by the front cover 3. The box 13 is adhered to the booklet 1. The spine 7 comprises a spine strip 23 which lies in the extended direction of the front cover 3 along the spine 7 when the booklet 1 is closed. Furthermore, the front cover 3 and the back cover 5 are also interconnected by means of a connection strip 27 situated at the leafing side 11. The flange 19 of the box 13 is adhered to the connection strip 27 and to the spine strip 23. Said connection strip 27 can be removed by means of a pair of scissors, but in FIG. 1 it is connected to the front cover 3 and the back cover 5 along a perforation line 29, so that it can be easily torn off. A bridging strip 31 lies in the extended direction of the front cover 3 and is connected to the spine strip 23, the front cover 3, the back cover 5, and the connection strip 27. An opening 33 is present in the bridging strip 31, in this case in the shape of a Euroslot. An effective use of the shelf space and an orderly product presentation are enabled in that the pack is suspended, for example, from a hook which is passed through the opening 33 provided in the bridging strip 31. The surfaces of the spine strip 23 and the front cover 3 both facing towards the box 13 are separated by a groove 25 in FIG. 1.

Figure 2:
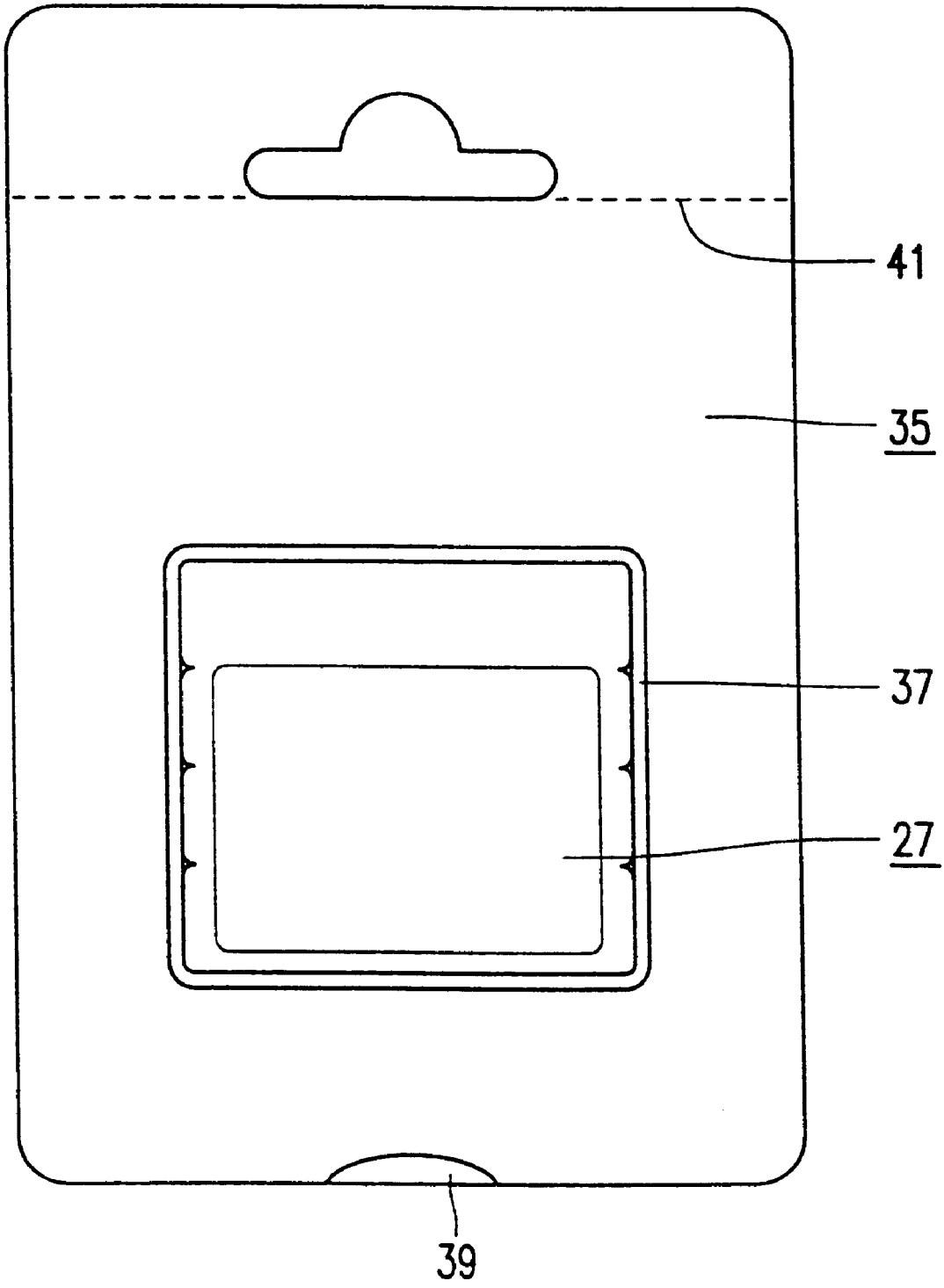
FIG. 2 is a front elevation of a modification of FIG. 1.

In FIG. 2, corresponding parts have been given the same reference numerals as in FIG. 1. The portions of the flange 19 connected to the spine strip 23 and the connection strip 27 are covered with a cover sheet 35. An opening 37 for the box 13 is present in the cover sheet 35, so that this box remains largely visible. The cover sheet 35 is in addition provided with a recess 39 and a perforation 41 which facilitate the removal of the cover sheet 35. The cover sheet 35 can be readily lifted up and torn loose, for example when a fingernail is passed under the cover sheet 35 adjacent the recess 39, whereupon the cover sheet 35 can be simply torn loose along the perforation 41.

Figure 3:
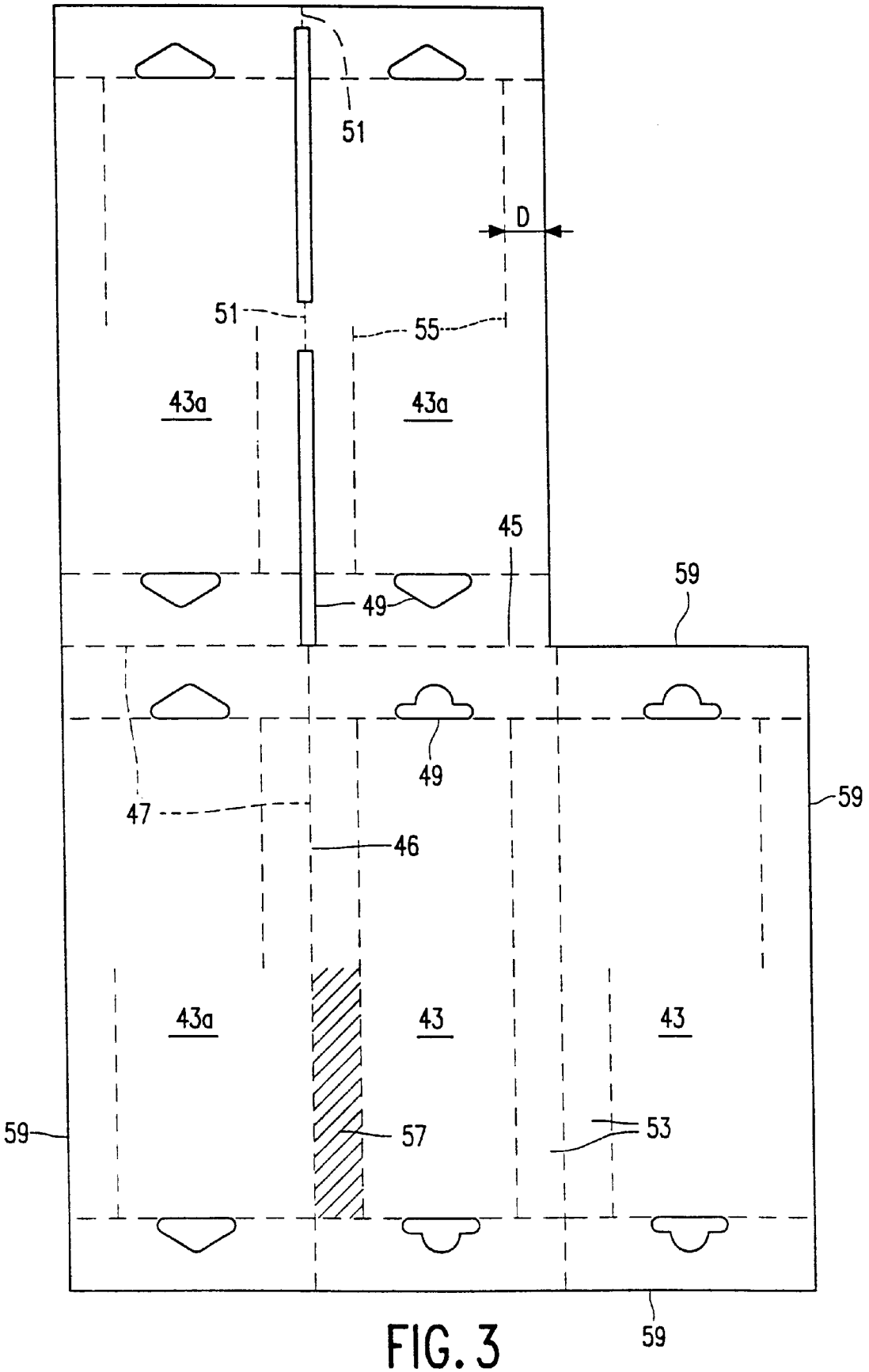
FIG. 3 shows the blank of the booklet of FIGS. 1 and 2.

A simple method of manufacturing the booklet is, for example, from a blank as shown in FIG. 3. The following method may be used for this.

The blank is subdivided into panels 43 which are interconnected along folding lines 45 and 46. The number of panels 43 determines the number of pages 9, including the front cover 3 and the back cover 5, which the booklet 1 will eventually have. Incisions 47 are provided on the folding lines 45 and 46, about which the panels 43 can be folded over later. Openings 49 having at least the material thickness are in addition provided around the folding lines 46 of those panels 43*a* which will come to lie on the inside with respect to other panels 43 after folding. These openings 49 extend over the major portion of the length of the folding line 46, so that the relevant panels 43*a* are still interconnected via bridges 51. The bridges 51 serve for fixation of the panels 43*a* with respect to one another. At the same time, strips 53 are formed in that perforations 55 are provided on each panel 43 parallel to the folding line 46 and at approximately a distance D therefrom. An adhesive agent 57, for example glue, is provided on the strips 53. When the blank is folded up, the panels 43*a* will come to lie within the enclosing panels 43. The booklet 1 shown in FIG. 1 is thus created as part of the blister pack. A booklet 1 obtained in the manner described above may be recognizable as such in the pack.

What is claimed is:

1. A blister pack comprising:

a booklet with a front cover, a back cover, a spine by means of which the front cover and the back cover are interconnected, and a leafing side opposite the spine where the booklet can be opened;

a box comprising a base with a circumferential raised wall with a flange connected thereto, and opposite the base an open side, which open side is at least substantially closed off by the front cover, while the flange is adhered to the booklet, wherein the spine comprises a spine strip which lies in the extended direction of the front cover along the spine when the booklet is closed, the front cover and the back cover are interconnected by means of a connection strip situated at the leafing side, and the flange is adhered to the connection strip and to the spine strip, and wherein the booklet can be opened only after the blister pack has been opened.

2. A blister pack comprising:

a booklet with a front cover, a back cover, a spine by means of which the front cover and the back cover are interconnected, and a leafing side opposite the spine where the booklet can be opened;

a box comprising a base with a circumferential raised wall with a flange connected thereto, and opposite the base an open side, which open side is at least substantially closed off by the front cover, while the flange is adhered to the booklet, wherein the spine comprises a spine strip which lies in the extended direction of the front cover along the spine when the booklet is closed, the front cover and the back cover are interconnected by means of a connection strip situated at the leafing side and connected to the front cover and to the back cover along a perforation line, and the flange is adhered to the connection strip and to the spine strip.

3. A blister pack as claimed in claim 2, wherein a bridging strip provided with an opening is present, which bridging strip lies in the extended direction of the front cover and is connected to the spine strip, the front cover, the back cover, and the connection strip.

4. A blister pack as claimed in claim 2, wherein at least those portions of the flange which are connected to the spine strip and to the connection strip are covered by means of a cover sheet.

5. A blister pack as claimed in claim 2, wherein the surfaces of the front cover and the spine strip which face towards the box are separated by a groove.

6. A blister pack as claimed in claim 3, wherein a bridging strip provided with an opening is present, which bridging strip lies in the extended direction of the front cover and is connected to the spine strip, the front cover, the back cover, and the connection strip.

7. A blister pack as claimed in claim 3, wherein at least those portions of the flange which are connected to the spine strip and to the connection strip are covered by means of a cover sheet.

8. A blister pack as claimed in claim 3, wherein the surfaces of the front cover and the spine strip which face towards the box are separated by a groove.

* * * * *